US005227273A

United States Patent [19]

Yoshida et al.

[11] Patent Number: 5,227,273

[45] Date of Patent: Jul. 13, 1993

[54] BINDER FOR TONER AND PROCESS FOR PRODUCING THE SAME

[75] Inventors: Keiji Yoshida; Ryo Funato; Syuji Takahiro, all of Nagoya; Shinji Kubo, Toyohashi; Motoshi Inagaki, Nagoya, all of Japan

[73] Assignee: Mitsubishi Rayon Co., Ltd., Tokyo, Japan

[21] Appl. No.: 780,383

[22] Filed: Oct. 23, 1991

Related U.S. Application Data

[63] Continuation-in-part of Ser. No. 533,364, Jun. 5, 1990, abandoned.

[30] Foreign Application Priority Data

Jun. 15, 1989 [JP] Japan ..... 1-150537

[51] Int. Cl.[5] ..... G03G 9/08

[52] U.S. Cl. ..... 430/110; 430/137; 524/457; 524/458; 524/460

[58] Field of Search ..... 430/110, 137; 524/458, 524/457, 459, 460

[56] References Cited

U.S. PATENT DOCUMENTS 4,652,511 3/1987 Ueda et al. ..... 430/137
4,845,007 7/1989 Hyosu et al. ..... 430/110

FOREIGN PATENT DOCUMENTS 0266697 5/1988 European Pat. Off. .
0297839 1/1989 European Pat. Off. .
2197656 5/1988 United Kingdom .

*Primary Examiner*—Marion E. McCamish
*Assistant Examiner*—S. Rosasco
*Attorney, Agent, or Firm*—Oblon, Spivak, McClelland, Maier & Neustadt

[57] ABSTRACT

A binder for toner comprising a styrene/(meth)acrylate copolymer obtained by polymerizing polymerizable vinyl monomers comprising styrene and/or its derivative and a (meth)acrylate by suspension polymerization of 0.001–3 wt. %, based on the total weight of the monomers used, of at least one polyvinyl alcohol having a degree of saponification of 75–98% and 1.0–10 wt. %, based on the total weight of the monomers used, of at least one azo initiator. According to the present invention, there is provided a binder for a toner which produces copied images having excellent stability of image quality (life) even after a large number of times of copying.

5 Claims, No Drawings

BINDER FOR TONER AND PROCESS FOR PRODUCING THE SAME

This application is a continuation-in-part of application Ser. No. 07/533,364, filed on Jun. 5, 1990, now abandoned.

BACKGROUND OF THE INVENTION

1. Field of the Invention

The present invention relates to a binder for toner using a styrene/(meth)acrylate copolymer obtained by a particular polymerization method. More particularly, it relates to a binder for toner using a styrene/(meth)acrylate copolymer obtained by a suspension polymerization method with a particular dispersing agent and initiator.

2. Description of Related Art

Hitherto, there are a large number of inventions on a binder resin for dry toners. Vinyl polymers used as a binder resin for toners are produced by suspension polymerization, bulk polymerization, solution polymerization, emulsion polymerization, etc., among which suspension polymerization is most superior in terms of a manufacturing cost.

However, it is not avoidable for the binder resin to contain the residual decomposition by-products of a dispersing agent and initiator used in the suspension polymerization. Toners using such a resin as a binder have problems in terms of chargeability, particularly stability of image quality (i.e., life).

SUMMARY OF THE INVENTION

The present inventors have extensively studied to solve the foregoing problems, and as a result, have found that a binder for toner comprising a styrene/(meth)acrylate copolymer obtained by polymerizing polymerizable vinyl monomers comprising styrene and/or its derivative and a (meth)acrylate by suspension polymerization with 0.001–3 wt. %, based on the total weight of the monomers, of at least one kind of polyvinyl alcohol having a degree of saponification of 75–98% and 1.0–10 wt. % based on the same of at least one kind of azo initiator, is excellent in stability of image quality. The present inventors thus completed this invention.

An object of the present invention is to provide a binder resin for a toner which can form copied images having excellent stability of image quality even after a large number of times of copying, namely, a toner having excellent life at a low cost.

Other objects and advantages of the present invention will become apparent from the following description.

PREFERRED EMBODIMENTS OF THE INVENTION

The polymerizable vinyl monomers used in the present invention may be any of those which produce a polymer by suspension polymerization and at least contains styrene or its derivative and a (meth) acrylate. Styrene and styrene derivatives include α-methylstyrene and substituted styrenes having methyl at an o- or m-position of the benzene ring, or methyl, ethyl, butyl, hexyl, octyl, nonyl, decyl, methoxy, phenyl or vinyl at a p-position of the benzene ring, or methyls at 2- and 4-positions thereof. (Meth)acrylates include acrylic acid esters and methacrylic acid esters represented by the formula: $CH_2{=}CR{-}COOR'$, where R represents hydrogen or methyl, and R' represents methyl, ethyl, n-propyl, isopropyl, n-butyl, isobutyl, sec-butyl, tertbutyl, n-pentyl, n-hexyl, n-octyl, 2-ethylhexyl, n-nonyl, isononyl, decyl, dodecyl, tridecyl, stearyl, docosyl, cyclohexyl, benzyl, phenyl, methoxyethyl, ethoxyethyl, butoxyethyl, phenoxyethyl, etc. Polymerizable vinyl monomers other than the indispensable monomers of styrene or its derivative and a (meth)acrylate include, vinyl esters such as vinyl acetate, vinyl propionate, etc; and acrylic acid derivatives or methacrylic acid derivatives such as acrylonitrile, methacrylonitrile, etc. These polymerizable vinyl monomers are used in admixture of two or more of them.

The acidic value of the binder of the present invention is preferably 3–40 mg KOH/g. As far as the acidic value is within this range, the binder is good in life. The acidic value can be controlled by using a polymerizable vinyl acid monomer.

The polymerizable vinyl acid monomer used herein refers to monomers having one or more acid substituents in addition to the polymerizable vinyl group. For example, it includes acrylic acid, methacrylic acid, itaconic acid, citraconic acid, maleic acid, fumaric acid, crotonic acid, monobutyl itaconate, monomethyl maleate, monobutyl maleate, monooctyl maleate, monooctyl itaconate, 2-sulfoethyl methacrylate, 2-sulfoethyl acrylate, 2-acrylamide-2-methylpropanesulfonic acid, vinylbenzenesulfonic acid, etc. These vinyl acid monomers are used alone or in admixture of two or more of them.

For obtaining the vinyl polymer used in the present invention, a suspension polymerization method is used.

An azo initiator is used in the suspension polymerization according to the present invention. Its kind is not critical, it being possible to use the well-known ones.

Preferred azo initiators are those which contain four to eight methyl groups and/or have a ten-hour half-life temperature of 80° C. or higher.

When an azo initiator which contains four to eight methyl groups is used, there is obtained a binder for toner which is excellent in stability of image quality (i.e. life) even if repetitive copying operations are carried out. Also, when an azo initiator which has a ten-hour half-life temperature of 80° C. or higher is used, there is obtained a binder for toner which contains only a small amount of residual monomers if the residual monomers are heat treated. Thus, fog-free high-resolution clear images can be realized. More preferably are used those which contain four to eight methyl groups as well as have a ten-hour half-life temperature of 80° C. or higher.

For example, there are mentioned azobisisobutyronitrile, 2,2'-azobis-(2,4-dimethylvaleronitrile), dimethyl-2,2'-azobisisobutyronitrile (ten-hour half-life temperature: 65° C.), 2,2'-azobis(2-methylbutronitrile) (do.: 67° C.), 2,2'-azobis(4-methoxy-2,4-dimethylvaleronitrile) (do.: 30° C.), 2,2'-azobis(2,4-dimethylvaleronitrile) (do.: 51° C.), 2,2'-azobis{2-methyl-N-[1,1-bis(hydroxymethyl)ethyl]propionamide (do.: 82° C.), 2,2'-azobis(2,4,4'-trimethylpentane) (do.: 110° C.), 2,2'-azobis(2-methylpropane) (do.: 160° C.), dimethyl 2,2'-azobis(2-methylpropionate) (do.: 66° C.), 1,1'-azobis(cyclohexane-1-carbonitrile) (do.: 88° C.) and the like. Among them, 2,2'-azobis(2,4'-dimethylvaleronitrile) is preferred.

These azo initiators are used alone or in admixture of two or more of them.

The amount of the azo initiator used is preferably 0.5–10 wt. %, more preferably 1–9 wt. % based on the total weight of the monomers used. So far as the initiator is used in an amount within this range, stable charging properties and fog-free images can be realized by the use of a toner with the binder.

The polyvinyl alcohol is used as a suspended dispersing agent in the synthesis of the binder of the present invention. The degree of saponification of the polyvinyl alcohol is preferably 75–98 wt. %, more preferably 80–90%. The amount of the polyvinyl alcohol used is preferably 0.001–3%, more preferably 0.05–2% based on the total weight of the monomers used. As far as the polyvinyl alcohol has a degree of saponification within that range and is used in an amount within this range, the binder can be steadily obtained. These polyvinyl alcohols may be used alone or in combination of two or more of them.

If necessary, a dispersion auxiliary may be used. It includes for example electrolytes such as sodium chloride, potassium chloride, sodium sulfate, potassium sulfate, etc.

In the present invention, a silicone antifoamer may be used after the polymerization to prevent foaming due to the decomposition of the azo initiator. Preferred silicone antifoamers are emulsion-type. The amount of the antifoamer used is preferably 0.1–10 wt. %, more preferably 0.5–8 wt. % based on the total weight of the monomers used. As far as the antifoamer is used in an amount within this range, the binder is steadily obtained and it has no adverse influence on charging properties. When the antifoamer is used in a large amount, the running characteristics of the toner become poor.

In one embodiment of the present invention, the styrene/(meth)acrylate copolymer is heated to treat the residual monomers at a temperature of 90° C. or higher in the presence of the silicone antifoamer. When the temperature is less than 90° C., the residual monomers are left unreacted, as a result of which images obtained by using the binder have much fog. When the temperature is 90° C. or higher, the residual monomer content is reduced, as a result of which good images are obtained. To treat the residual monomers, distillation may be carried out. In this case, the residual monomers and the deionized water which is used in the reaction are preferably distilled out of the reaction system in the form of a mixed solution of the both containing about 5–25% of the residual monomers. This distillation is preferably carried out at 100° C. or higher.

The condition of the suspension polymerization varies with the kind of the polymerizable vinyl monomers, kind of the azo initiators and the amounts thereof. However, the polymerization temperature is generally 30° to 130° C., preferably 60° to 100° C., and the polymerization time is preferably about 1 to about 10 hours.

The present invention is illustrated below with reference to the following Examples. In the Examples, parts are by weight. However, these examples are not to be construed to limit the present invention.

EXAMPLE 1

Three parts 2,2'-azobis (2,4-dimethylvaleronitrile) an azo initiator, was dissolved in a polymerizable vinyl monomer mixture consisting of 83 parts of styrene, 17 parts of 2-ethylhexyl acrylate and 0.3 part of divinylbenzene. The resulting mixture was mixed with a polymerization medium obtained by dissolving 0.2 part of a polyvinyl alcohol (PVA-224E produced by KURARAY CO., LTD.) in 220 parts of deionized water. The mixture was heated to 70° C., and suspension polymerization was carried out for 90 minutes at this temperature. After the polymerization reaction was completed, two parts of a silicone antifoamer KM-70 (produced by Shin-Etsu Chemical Co., Ltd.) was added to the mixture. The mixture was heated to reflux at 100° C. with a Liebig condenser attached to the reactor. A mixed solution of the ionized water and the residual monomers began to distill out of the reaction system. The distillation ceased at the point of time when the distillate amounted to 33 parts. The resulting polymer dispersion was cooled to room temperature and filtered. The solid matter obtained was thoroughly washed, dehydrated and dried to obtain a bead-form binder resin of an acid value of 1 mg KOH/g.

Ninety-two parts of the above binder resin, 7 parts of carbon black (#40 produced by Mitsubishi Kasei Corp.) and 1 part of a charge control agent (BONTRON S-34 produced by ORIENT CHEMICAL INDUSTRIES, LTD.) were kneaded at 150° C. for about 5 minutes on a twin-screw extruder. After cooling, the kneaded product was finely pulverized on a jet mill. The fine powders obtained were classified to collect fine powders having a particle size of 5 to 15 μm. The volume mean diameter of the fine powders was 9.6 μm.

A copying test was carried out on a commercially available copying machine (Ricopy FT 4510 produced by RICOH CO., LTD.) using the above fine powders as a toner. As a result, fog-free high-resolution clear images were obtained at the initial stage of copying and after 10,000 copying operations. After 20,000 copying operations, however, the images showed a faint touch of fog and a somewhat lowered resolution degree, which were however of such a degree as to be out of the question in practical use.

EXAMPLE 2

Three parts of 2,2'-azobis(2-methylbutyronitrile) and one part of 1,1'-azobis(cyclohexane-1-carbonitile) were dissolved in a polymerizable vinyl monomer mixture consisting of 81 parts of styrene, 17 parts of 2-ethylhexylacrylate, two parts of methacrylic acid and 0.3 part of divinyl benzene. The resulting mixture was mixed with a polymerization medium obtained by dissolving 0.2 part of a polyvinyl alcohol having a degree of saponification of 88% (PVA-224E) in 220 parts of deionized water. The mixture was heated to 75° C., and suspension polymerization was carried out for 120 minutes at this temperature. After the polymerization reaction was complete, five parts of a silicone antifoamer KM-70 (produced by Shin-Etsu Chemical Co., Ltd.) was added to the mixture. The mixture was heated to 95° C. to treat the residual monomers for 120 minutes. The resulting polymer dispersion was cooled to room temperature and filtered. The solid matter obtained was thoroughly washed, dehydrated and dried to obtain a bead-form binder resin of an acid value of 11 mg KOH/g. A toner was made using this binder resin in the same manner as in Example 1. The performances of this toner were evaluated, and it was found that fog-free high-resolution clear images were obtained even after 20,000 copying operations.

EXAMPLE 3

A binder resin having an acid value of 32 mg KOH/g was obtained in the same manner as in Example 1 except that 78 parts of styrene, 17 parts of 2-ethylhexyl acrylate, 5 part of methacrylic acid and 0.3 part of divinylbenzene were used as the polymerizable vinyl monomers. A toner was made using this binder resin in the same manner as in Example 1. The performances of this toner were evaluated, and it was found that fog-free high-resolution clear images were obtained even after 20,000 copying operations, by which, however, the fixability and grindability were somewhat lowered.

COMPARATIVE EXAMPLE 1

A toner was obtained in the same manner as in Example 1 except that 3 parts of benzoyl peroxide, which is not an azo initiator, was used as the polymerization initiator, and that the polymerization temperature was 85° C. The performances of this toner were evaluated, and it was found that the images at the initial stage of copying were fog-free high-resolution clear ones, but that after 10,000 copying operations, only images having a touch of fog and a lowered resolution degree were obtained.

COMPARATIVE EXAMPLE 2

The polymerization was carried out and the residual monomers were treated in the same manner as in Example 2 except that the silicone antifoamer was not used. As a result, vigorous foaming was observed in the reaction system during the treatment of the residual monomers and then the resulting resin was solidified.

COMPARATIVE EXAMPLE 3

A binder resin having a acidic value of 31 mg KOH/g was obtained in the same manner as in Example 2 except that the residual monomers were not treated. A toner was made using this binder resin in the same manner as in Example 1.

The performances of this toner were evaluated, and it was found that the images at the initial stage of copying were fog-free high-resolution clear ones, but that after 5,000 copying operations, only images having a touch of fog and a lowered resolution degree were obtained.

EXAMPLE 4

A binder resin having an acidic value of 7 mg KOH/g, which is a super high molecular weight styrene/n-butyl acrylate polymer, was obtained in the same manner as in Example 1 except that eight parts of 2,2'-azobis(2,4-dimethylvaleronitrile) was dissolved in a polymerizable vinyl monomer mixture consisting of 140 parts of an emulsion composed of 85 wt. % of styrene and 15 wt. % of n-butyl acrylate (solid matter 14%), 82.5 parts of styrene, 17 parts of 2-ethylhexyl acrylate and 0.5 part of methacrylic acid, and that eight parts of the silicone antifoamer KM-70 and two parts of the polyvinyl alcohol PVA-224E were used. A toner was made using this binder resin in the same manner as in Example 1. The performances of this toner were evaluated, and it was found that fog-free high-resolution clear images were obtained at the initial stage of copying and even after 10,000 copying operations, but after 20,000 copying operations, the images showed a faint touch of fog, which was however of such a degree as to be out of the question in practical use.

COMPARATIVE EXAMPLE 4

A toner was obtained in the same manner as in Example 2 except that 0.2 part of an anion-modified polyvinyl alcohol (KL-318 produced by KURARAY CO., LTD.) was used as the dispersing agent. The performances of this toner were evaluated, and it was found that the images at the initial stage of copying were fog-free high-resolution clear ones, but that after 10,000 copying operations, only images having a touch of fog and a lowered resolution degree were obtained.

COMPARATIVE EXAMPLE 5

A toner was obtained in the same manner as in Example 1 except that 0.2 part of a cation-modified polyvinyl alcohol (C-318 produced by KURARAY CO., LTD.) was used as the dispersing agent. The performances of this toner were evaluated, and it was found that the images at the initial stage of copying were fog-free high-resolution clear ones, but that after 5,000 copying operations, only images having a touch of fog and a lowered resolution degree were obtained.

COMPARATIVE EXAMPLE 6

A toner was obtained in the same manner as in Example 2 except that 0.2 part of a cation-modified polyvinyl alcohol (C-318 produced by KURARAY CO., LTD.) was used as the dispersing agent. The performances of this toner were evaluated, and it was found that the images at the initial stage of copying were fog-free high-resolution clear ones, but that after 10,000 copying operations, only images having a touch of fog and a lowered resolution degree were obtained.

What is claimed is:

1. A binder for toner comprising a styrene/(meth)acrylate copolymer obtained by polymerizing polymerizable vinyl monomers comprising styrene and/or its derivative and a (meth)acrylate by suspension polymerization of 0.001–3 wt. %, based on the total weight of the monomers used, of at least one polyvinyl alcohol having a degree of saponification of 75–98% and 1.0–10 wt. %, based on the total weight of the monomers used, of at least one azo initiator.

2. A binder for toner according to claim 1, wherein said azo initiator contains four to eight methyl groups and/or has a ten-hour half-life temperature of 80° C. or higher.

3. A binder for toner according to claim 1, wherein the acid value of said binder is 3–40 mg KOH/g.

4. A binder for toner comprising a styrene/(meth)acrylate copolymer obtained by polymerizing polymerizable vinyl monomers comprising styrene and/or its derivative and a (meth)acrylate by suspension polymerization of 0.001–3 wt. %, based on the total weight of the monomers used, of at least one polyvinyl alcohol having a degree of saponification of 75–98% and 1.0–10 wt. %, based on the total weight of the monomers used, of at least one azo initiator and then treating and/or distilling residual monomers with 0.1–10 wt. %, based on the total weight of the monomers used, of a silicone antifoamer at a temperature of 90° C. or higher.

5. A process for producing a binder resin for resin comprising the steps of polymerizing polymerizable vinyl monomers comprising styrene and/or its derivative and a (meth)acrylate by suspension polymerization with 0.001–3 wt. %, based on the total weight of the monomers used, of at least one polyvinyl alcohol having a degree of saponification of 75–98% and 1.0–10 wt. %, based on the total weight of the monomers used, of at least one azo initiator and then treating and/or distilling residual monomers with 0.1–10 wt. %, based on the total weight of the monomers used, of a silicone antifoamer at a temperature of 90° C. or higher.

* * * * *